US010384898B2

(12) United States Patent
Yeh

(10) Patent No.: US 10,384,898 B2
(45) Date of Patent: Aug. 20, 2019

(54) FIXING APPARATUS AND AUTOMATIC SYSTEM

(71) Applicant: Shih-Hao Ray Yeh, Delta (CA)

(72) Inventor: Shih-Hao Ray Yeh, Delta (CA)

( * ) Notice: Subject to any disclaimer, the term of this patent is extended or adjusted under 35 U.S.C. 154(b) by 620 days.

(21) Appl. No.: 15/157,480

(22) Filed: May 18, 2016

(65) Prior Publication Data

US 2017/0183195 A1 Jun. 29, 2017

(30) Foreign Application Priority Data

Dec. 24, 2015 (TW) ..... 104143651 A

(51) Int. Cl.
*B65H 16/06* (2006.01)
*B65H 19/12* (2006.01)
*B65H 75/24* (2006.01)

(52) U.S. Cl.
CPC ..... *B65H 16/06* (2013.01); *B65H 19/126* (2013.01); *B65H 75/243* (2013.01); *B65H 2301/41344* (2013.01); *B65H 2301/41366* (2013.01); *B65H 2406/423* (2013.01); *B65H 2701/173* (2013.01)

(58) Field of Classification Search
CPC .... B65H 16/06; B65H 75/243; B65H 19/126; B65H 2701/173; B65H 2406/423; B65H 2301/41344; B65H 2301/41366
See application file for complete search history.

(56) References Cited

U.S. PATENT DOCUMENTS

2009/0294570 A1* 12/2009 Wenk ..... B65H 19/126
242/563.1

FOREIGN PATENT DOCUMENTS

| | | | | |
|---|---|---|---|---|
| CN | 101024458 A | | 8/2007 | |
| CN | 201834579 U | | 5/2011 | |
| CN | 103343773 A | | 10/2013 | |
| CN | 103990896 A | | 8/2014 | |
| CN | 104176539 A | | 12/2014 | |
| EP | 1149786 A2 | * | 10/2001 | ..... B65H 16/06 |
| TW | M453879 U1 | | 5/2013 | |

* cited by examiner

*Primary Examiner* — William E Dondero
(74) *Attorney, Agent, or Firm* — Volpe and Koenig, P.C.

(57) ABSTRACT

A fixing structure for fixing a reel is disclosed. The fixing structure includes a shaft having a first end having a first plurality of protrusions, and a second end having a second plurality of protrusions, wherein each of the first plurality of protrusions and one of its adjacent protrusions have a first recess therebetween, and each of the second plurality of protrusions and one of its adjacent protrusions have a second recess therebetween; and a supporting device, including a first supporting portion supporting the first end, and having a first protruding portion abutting the first recess; and a second supporting portion supporting the second end, and having a second protruding portion abutting the second recess.

16 Claims, 6 Drawing Sheets

FIXING APPARATUS AND AUTOMATIC SYSTEM

CROSS-REFERENCE TO RELATED APPLICATION AND CLAIM OF PRIORITY

The application claims the benefit of Taiwan Patent Application No. 104143651, filed on Dec. 24, 2015, at the Taiwan Intellectual Property Office, the disclosures of which are incorporated herein in their entirety by reference.

FIELD OF THE INVENTION

The present invention is related to a fixing apparatus and an automatic system, and more particularly to a fixing apparatus and an automatic system using a shaft and a supporting device.

BACKGROUND OF THE INVENTION

Currently, the processes of putting an air shaft into a copper foil reel and installing the air shaft are mostly performed manually. When the air shaft is to be installed on the chuck, usually the operator needs to align the tenon on the air shaft with the mortise in the chuck with his eyes to cause the tenon to engage with the mortise after the alignment. In this process, if the angle of the tenon on the air shaft to be transported is not aligned with the mortise in the chuck, the operator needs to laboriously rotate the air shaft to a right angle because a general copper foil reel weigh more than three hundred kilograms. In addition, even if the tenon on the air shaft is aligned with the mortise in the chuck, the operator still needs to use a tool to beat the tenon on the air shaft to cause it to closely engage with the mortise in the chuck. Therefore, this operating process of using the operator to identify the installation position, rotate and align the air shaft and the mortise, and beat the air shaft and the mortise not only endangers the safety of the operator, but also damages the mechanism itself, thereby affecting factory safety and product yield.

In order to overcome the drawbacks in the prior art, a fixing apparatus and an automatic system are disclosed. The particular design in the present invention not only solves the problems described above, but also is easy to implement. Thus, the present invention has utility for the industry.

SUMMARY OF THE INVENTION

The fixing apparatus of the present invention is applicable to an automation system, which not only can automatically transport a shaft sleeving thereon a reel to a supporting device, but can also automatically align the position between the shaft and the supporting device. In addition, the shaft can be placed into the supporting device without rotation, and then a pneumatic unit connected to the supporting device is used to drive a component in the supporting device to move to cause the shaft to be fixed on the supporting device. Moreover, even if the fixing apparatus of the present invention is operated in the production state, the accuracy of the action thereof is not affected. Therefore, the fixing apparatus and the automatic system of the present invention not only reduce the probability of operator negligence, but also ensure the safety of the operator and the product yield, reduce the probability of damaging the apparatus due to manual operation, and enhance the possibility to produce various products.

In accordance with an aspect of the present invention, a fixing apparatus for fixing a reel is disclosed. The fixing apparatus includes a shaft having a first end with a first plurality of protrusions and a second end with a second plurality of protrusions, wherein each of the first plurality of protrusions and one of its adjacent protrusions have a first recess therebetween, and each of the second plurality of protrusions and one of its adjacent protrusions have a second recess therebetween; and a supporting device, including a first supporting portion supporting the first end, and having a first protruding portion engaging the first recess when the first supporting portion accommodates the first end; a second supporting portion supporting the second end, and having a second protruding portion engaging the second recess when the second supporting portion accommodates the second end; a first component disposed on the first supporting portion, and having a first protruding element fixing the first supporting portion and the first end; and a second component disposed on the second supporting portion, and having a second protruding element fixing the second supporting portion and the second end.

In accordance with another aspect of the present invention, an automatic system for use in one of a printed circuit multilayer board plant and a copper foil substrate plant is disclosed. The automatic system includes a reel; a fixing device fixing thereto the reel and including a shaft having a first end having a first plurality of protrusions, and a second end having a second plurality of protrusions, wherein each of the first plurality of protrusions and one of its adjacent protrusions have a first recess therebetween, and each of the second plurality of protrusions and one of its adjacent protrusions have a second recess therebetween; a supporting device, including: a first supporting portion supporting the first end, and having a first protruding portion abutting one of the first recesses; and a second supporting portion supporting the second end, and having a second protruding portion abutting one of the second recesses; and a transporting device driving the shaft to the supporting device.

In accordance with a further aspect of the present invention, a fixing structure for fixing a reel is disclosed. The fixing structure includes a shaft having a first end having a first plurality of protrusions, and a second end having a second plurality of protrusions, wherein each of the first plurality of protrusions and one of its adjacent protrusions have a first recess therebetween, and each of the second plurality of protrusions and one of its adjacent protrusions have a second recess therebetween; and a supporting device, including a first supporting portion supporting the first end, and having a first protruding portion abutting the first recess; and a second supporting portion supporting the second end, and having a second protruding portion abutting the second recess.

The above objectives and advantages of the present invention will become more readily apparent to those ordinarily skilled in the art after reviewing the following detailed descriptions and accompanying drawings, in which:

BRIEF DESCRIPTION OF THE DRAWINGS

FIG. 2(*b*) shows the shaft and the supporting device in FIG. 2(*a*) after engagement;

FIG. 2(*c*) shows the shaft and the supporting device in FIG. 2(*a*) after engagement and fixing;

FIGS. 3(*b*)-3(*c*) show an end of the shaft in FIG. 2(*a*);

DETAILED DESCRIPTION OF THE PREFERRED EMBODIMENTS

The present invention will now be described more specifically with reference to the following embodiments. It is to be noted that the following descriptions of preferred embodiments of this invention are presented herein for the purposes of illustration and description only; they are not intended to be exhaustive or to be limited to the precise form disclosed.

Figure 1:
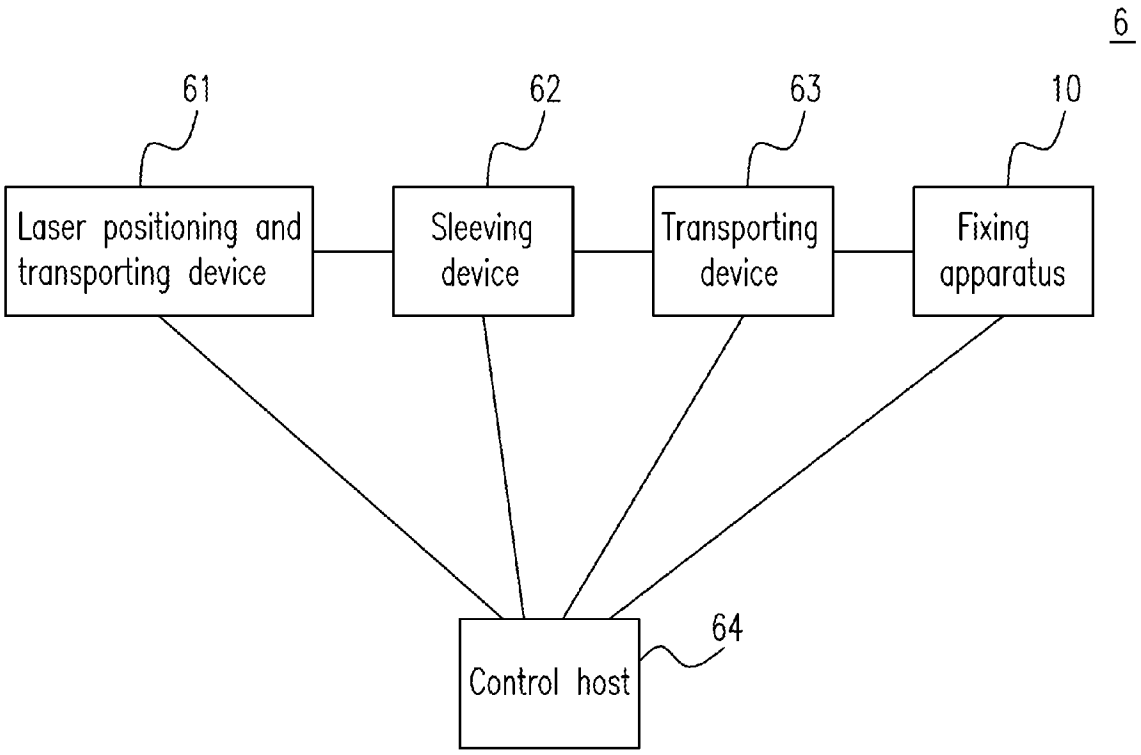
FIG. 1 shows an automatic system according to an embodiment of the present invention.
Figure 2A:
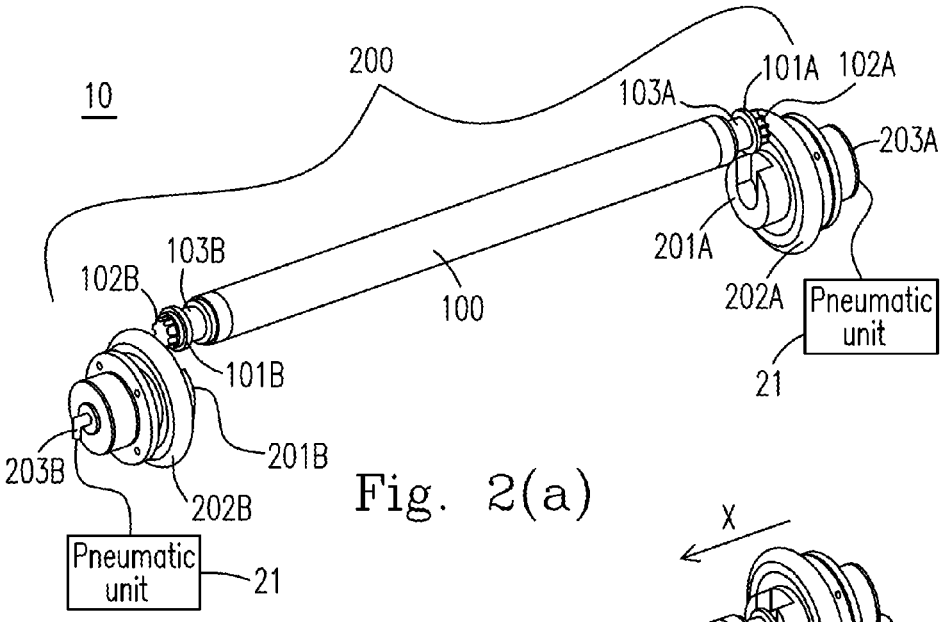
FIG. 2(*a*) shows a shaft and a supporting device before engagement according to an embodiment of the present invention.
Figure 2B:
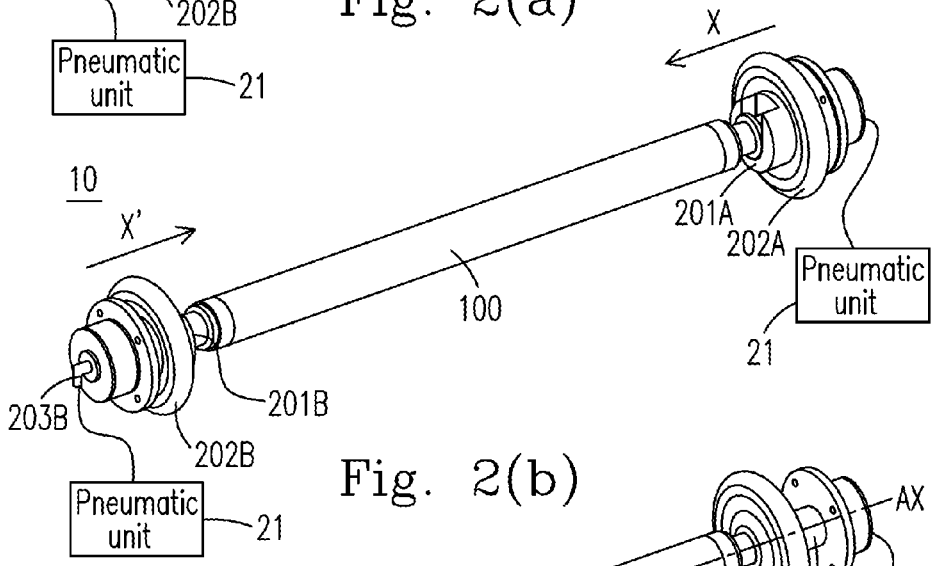
Figure 2C:
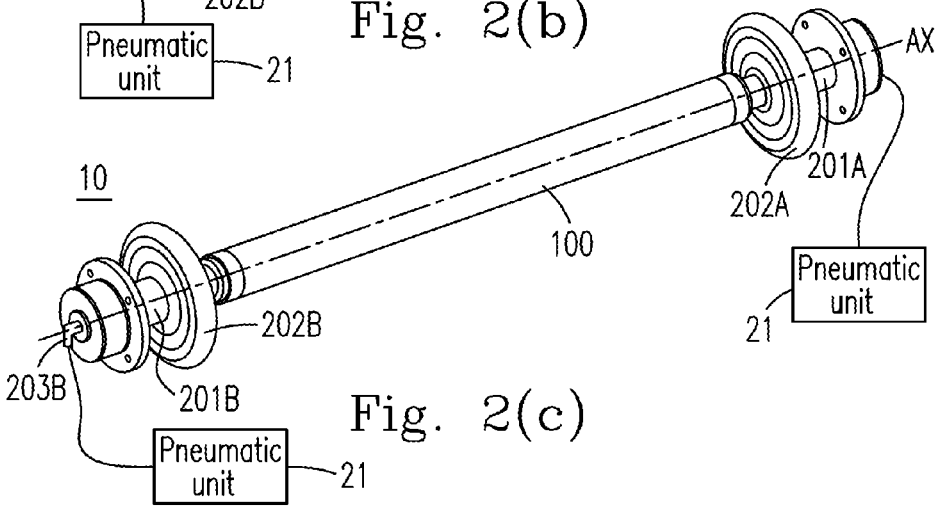
Figure 3A:
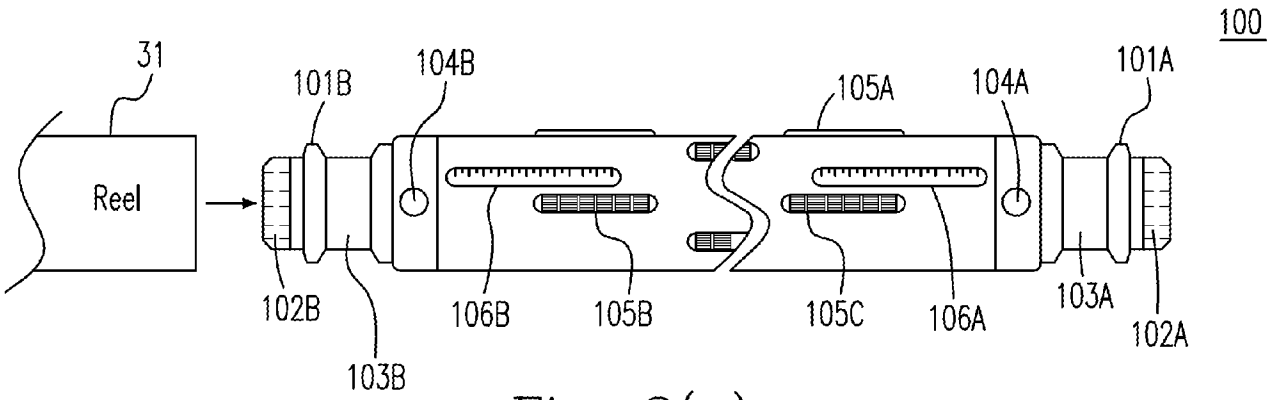
FIG. 3(*a*) is a top view of the shaft in FIG. 2(*a*)
Figure 3C:
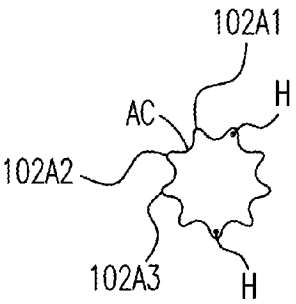

Please refer to FIG. 1, FIGS. 2(*a*)-2(*c*) and FIGS. 3(*a*)-3(*c*). FIG. 1 shows an automatic system 6 according to an embodiment of the present invention. FIG. 2(*a*) shows a shaft 100 and a supporting device 200 before engagement according to an embodiment of the present invention, FIG. 2(*b*) shows the shaft 100 and the supporting device 200 in FIG. 2(*a*) after engagement, and FIG. 2(*c*) shows the shaft 100 and the supporting device 200 in FIG. 2(*a*) after engagement and fixing. FIG. 3(*a*) is a top view of the shaft 100 in FIG. 2(*a*), and FIGS. 3(*b*)-3(*c*) show an end of the shaft 100 in FIG. 2(*a*);

As shown in FIG. 1, the present invention discloses a fixing apparatus 10 and an automatic system 6. The automatic system 6 basically includes a laser positioning and transporting device 61, a sleeving device 62, the fixing apparatus 10, a transporting device 63 and a control host 64. The fixing apparatus 10 includes a shaft 100 and a supporting device 200. The automatic system 6 is switched on by issuing a command to the control host 64 by an operator. The command includes instructing the transportation of a reel 31 to the laser positioning and transporting device 61 to position the reel 31. The shaft 100 is placed into the reel 31 by the sleeving device 62, and one of buttons 104A, 104B is pressed to cause the shaft 100 to automatically inflate, thereby causing the shaft 100 to closely fit with the reel 31. Then, the shaft 100 with the reel 31 is accurately and stably transported to the supporting device 200 by the transporting device 63. Finally, a component in the supporting device 200 is moved by pressure generated by a pneumatic unit 21 connected to the supporting device 200 so that the engagement between the shaft 100 and the supporting device 200 is achieved.

The laser positioning and transporting device 61 is configured to position and transport the reel 31. The error of the positioning accuracy is about ±0.15 mm so that the problem of the visual error by the operator can be reduced. The sleeving device 62 is configured to place the shaft 100 into the reel 31. The transporting device 63 is configured to transport the shaft 100 with the reel 31 to the supporting device 200. The sleeving device 62 and the transporting device 63 both have the advantage of reducing danger due to manual operation.

The fixing apparatus 10 and the automatic system 6 of the present invention can be used to produce and cut the main material of the printed circuit board (PCB) or the copper clad laminate (CCL), e.g. the copper foil.

Regarding the fixing apparatus 10 of the present invention, please refer to FIGS. 2(*a*)-2(*c*). As shown in FIGS. 2(*a*)-2(*c*), the fixing apparatus 10 of the present invention includes the shaft 100, the supporting device 200, the pneumatic unit 21 connected to the supporting device 200, and a reference axis AX passing through the shaft 100 and the supporting device 200. The shaft 100 has a first end 101A, a second end 101B, a first plurality of protrusions 102A disposed on a first surface of the first end 101A, a second plurality of protrusions 102B disposed on a second surface of the second end 101B, a first clamping portion 103A disposed on a third surface opposite to the first surface, and a second clamping portion 103B disposed on a fourth surface opposite to the second surface.

The supporting device 200 includes a first supporting portion 201A, a second supporting portion 201B, a first component 202A disposed on the first supporting portion 201A, a second component 202B disposed on the second supporting portion 201B, a first air tube 203A and a second air tube 203B.

No matter which direction the shaft 100 rotates with respect to the reference axis AX, when the shaft 100 is placed into the supporting device 200, the first plurality of protrusions 102A of the shaft 100 are engaged with the first supporting portion 201A, and the second plurality of protrusions 102B are engaged with the second supporting portion 201B. The first component 202A and the second component 202B of the supporting device 200 control the respective elastomers in the first supporting portion 201A and the second supporting portion 201B to be compressed or elongated through pressure generated by a first air output by the pneumatic unit 21 passing through the first air tube 203A and the second air tube 203B, thereby affecting the movement of the first component 202A and the second component 202B. The first component 202A moves along a first direction X parallel to the reference axis AX, and the second component 202B moves along a second direction X' opposite to the first direction X to fix the shaft 100 and the supporting device 200. The engagement mechanism and the fixing mechanism will be described in detail below.

According to an embodiment of the present invention, the elastomer can be a spring.

Please refer to FIGS. 3(*a*)-3(*c*). As shown in FIG. 3(*a*), in addition to the first end 101A, the second end 101B, the first plurality of protrusions 102A, the second plurality of protrusions 102B, the first clamping portion 103A and the second clamping portion 103B, the shaft 100 further includes a plurality of buttons 104A, 104B disposed on the shaft 100, a plurality of grooves 105A, 105B, 105C and a plurality of scales 106A, 106B. The transporting device 63 can clamp the first clamping portion 103A and the second clamping portion 103B to move the shaft 100. The buttons 104A, 104B are disposed so that when one of the buttons 104A, 104B is pressed, a second air is injected into the shaft 100 to cause the shaft 100 and the grooves 105A, 105B, 105C to have an expanded state. The scales 106A, 106B are disposed to control the position of the reel 31 having a hollow portion sleeved on the shaft 100.

When the reel 31 is sleeved on the shaft 100, the shaft 100 in the expanded state will closely fit with the reel 31, and friction is generated between the grooves 105A, 105B, 105C in the expanded state and an inner surface of the hollow portion so that the fixing between the shaft 100 and the reel 31 is strengthened.

According to an embodiment of the present invention, the transporting device 63 can be a cart, a crane or any device which can automatically transport an object. The shaft 100 is an air shaft. The buttons 104A, 104B can be any device which can cause the air shaft to automatically inflate. The grooves 105A, 105B, 105C are stripes, grids, concave-convex units, patterns or an arbitrary combination thereof. The reel 31 is a copper foil or a half-solidified sheet.

Figure 3B:
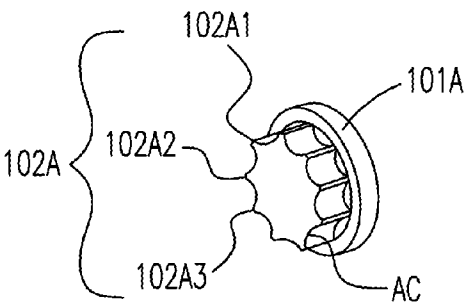

As shown in FIG. 3(B), the first end 101A has the first plurality of protrusions 102A, wherein the first plurality of protrusions 102A includes a first protrusion 102A1, a second protrusion 102A2, a third protrusion 102A3, etc. The first protrusion 102A1 and the second protrusion 102A2 have a recess AC therebetween, and the second protrusion 102A2 and the third protrusion 102A3 also have a recess AC therebetween.

In addition, the first plurality of protrusions 102A have a first plurality of centroids H. The first plurality of centroids and the reference axis AX have a first plurality of vertical line segments therebetween, wherein each of the first plurality of vertical line segments and one of its adjacent vertical line segments have a first angle therebetween.

Because the structure of the second end 101B is identical to that of the first end 101A, similarly the second end 101B also has the second plurality of protrusions 102B, and each of the second plurality of protrusions 102B and one of its adjacent protrusions have a second recess therebetween. The second plurality of protrusions 102B have a second plurality of centroids (not shown). The second plurality of centroids and the reference axis AX have a second plurality of vertical line segments therebetween, wherein each of the second plurality of vertical line segments and one of its adjacent vertical line segments have a second angle therebetween.

According to an embodiment of the present invention, the first angle and the second angle are at most 45 degrees, the number of the first plurality of protrusions 102A is a value obtained by a circumferential angle (i.e. 360 degrees) divided by the first angle, and the number of the second plurality of protrusions 102B is a value obtained by a circumferential angle divided by the second angle.

According to an embodiment of the present invention, the first angle is 40 degrees, and the number of the first plurality of protrusions 102A is 9. According to an embodiment of the present invention, the second angle is 40 degrees, and the number of the second plurality of protrusions 102B is 9.

Figure 4B:
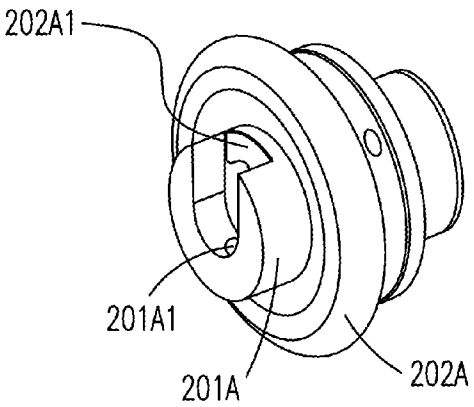
FIGS. 4(*a*)-4(*b*) show the supporting device in FIG. 2(*a*) in an open state.
Figure 4A:
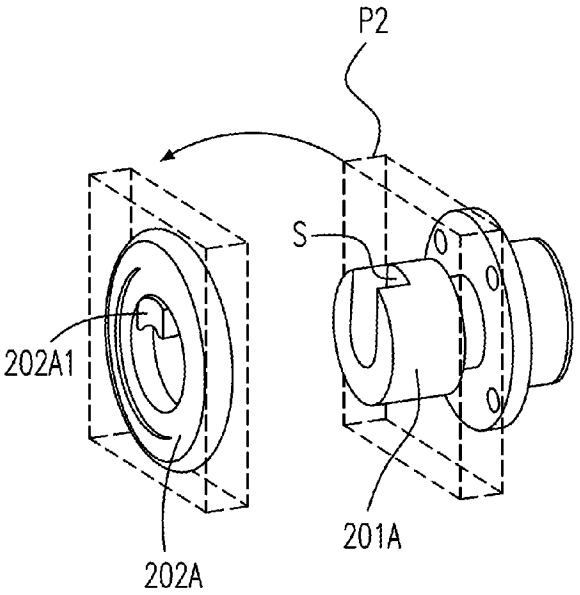

Please refer to FIGS. 4(*a*), 4(*b*), 5(*a*) and 5(*b*). FIGS. 4(*a*) and 4(*b*) show the supporting device 200 in FIG. 2(*a*) in an open state, and FIGS. 5(*a*) and 5(*b*) show the supporting device 200 in FIG. 2(*a*) in a closed state. As shown in FIGS. 4(*a*), 4(*b*), 5(*a*) and 5(*b*), the first supporting portion 201A of the supporting device 200 has a first protruding portion 201A1 embedded therein, a first surface S, a first elastomer 201A2 embedded on the first surface S, and the first component 202A disposed thereon, wherein the first component 202A has a first protruding element 202A1. The second supporting portion 201B of the supporting device 200 has a second protruding portion (not shown) embedded therein, a second surface (not shown), a second elastomer (not shown) embedded on the second surface, and the second component 202B disposed thereon, wherein the second component 202B has a second protruding element (not shown).

The "fixing mechanism" of the present invention is that when the first supporting portion 201A is driven due to relief of the pressure in the first air 203A, the first elastomer 201A1 in the first supporting portion 201A is elongated to drive the first component 202A to move to a first position P1 along the first direction X, thereby causing the first protruding element 202A1 to be engaged and fixed with the first supporting portion 201A and the first end 101A disposed on the first supporting portion 201A to form a closed state. Meanwhile, the second elastomer in the second supporting portion 201B is also elongated due to relief of the pressure to drive the second component 202B to move to a second position (not shown) along the second direction X', thereby causing the second protruding element to also be engaged and fixed with the second supporting portion 201B and the second end 101B disposed on the second supporting portion 201B to form the closed state. Therefore, when the supporting device 200 is in the closed state, it can be further ensured that the first plurality of protrusions 102A and the second plurality of protrusions 102B of the shaft 100 of the present invention are completely engaged with the supporting device 200. Thus, when a motor is switched on to rotate the fixing apparatus 10, the shaft 100 will not separate from the supporting device 200 due to the rotation.

Conversely, when the first supporting portion 201A is driven due to generation of the pressure in the first air tube 203A, the first elastomer 201A2 is compressed because the pressure generated is greater than the force of the first elastomer 201A2, thereby causing the first component 202A to move from the first position P1 to a third position P2 along the second direction X' to form an open state. Meanwhile, the second elastomer is also compressed because the pressure generated is greater than the force of the second elastomer, thereby causing the second component 202B to move from the second position to a fourth position (not shown) along the first direction X to simultaneously form the open state. Therefore, when the supporting device 200 is in the open state, the transporting device 63 of the automatic system 6 of the present invention can clamp the first clamping portion 103A and the second clamping portion 103B on the shaft 100 to take out the shaft 100 in the supporting device 200, and place another shaft with another reel having a different size into the supporting device 200.

Figure 5B:
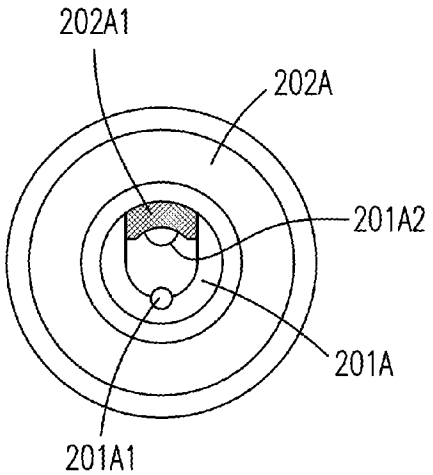
FIGS. 5(*a*)-5(*b*) show the supporting device in FIG. 2(*a*) in a closed state.
Figure 5A:
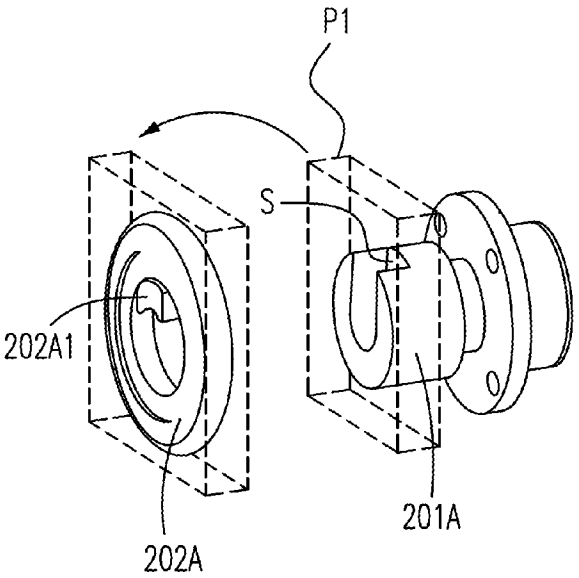

According to an embodiment of the present invention, no matter what state (the closed state or the open state) the supporting device 200 is in, the first protruding element 202A1 partly covers the first elastomer 201A2 (as shown in FIG. 5(B)), and the second protruding element partly covers the second elastomer.

Figure 6B:
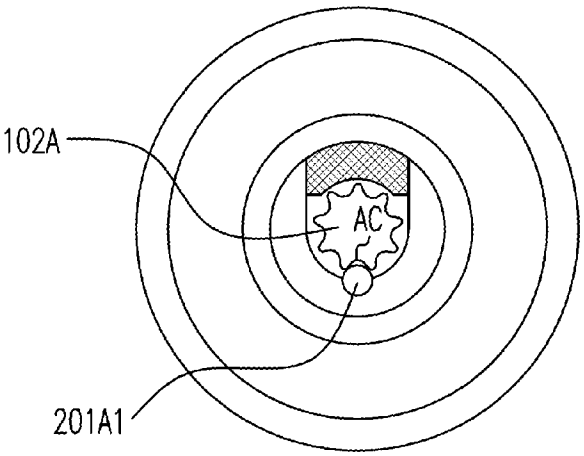
FIGS. 6(*a*)-6(*b*) show that a protruding portion of a supporting portion of the supporting device in FIG. 2(*a*) is engaged with a recess of the shaft in FIG. 2(*a*).
Figure 6A:
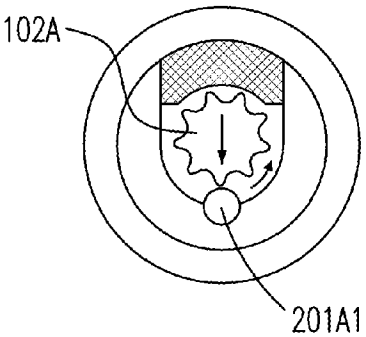

Regarding the "engaging mechanism" of the present invention, please refer to FIGS. 6(*a*)-6(*b*), which show that a protruding portion 201A1 of a supporting portion 201A of the supporting device 200 in FIG. 2(*a*) is engaged with a recess AC of the shaft 100 in FIG. 2(*a*). As shown in FIG. 6(A), when the shaft 100 is placed into the supporting device 200, if one protrusion of the first plurality of protrusions 102A (or the second plurality of protrusions 102B) props up the first protruding portion 201A1 embedded in the first supporting portion 201A, the protrusion generates a rolling force due to the weight of the shaft 100 and the special shape design (circle-like) of the first plurality of protrusions 102A. This causes the protrusion to automatically rotate, thereby causing the position of the protrusion to be replaced by the first recess AC between two protrusions. The first recess AC is engaged with the first protruding portion 201A1 to form an engagement structure, as shown in FIG. 6(B).

It can be seen from the above descriptions that no matter what angle the shaft 100 rotates with respect to the reference axis AX, it can be secured on the supporting device 200. This is because of the shape and number of the first plurality of protrusions 102A, the shape and number of the second plurality of protrusions 102B, the shape of the first recess AC, the shape of the second recess, the shape of the first protruding portion 201A1, the shape of the second protruding portion, the first angle, the second angle, etc.

The shapes (i.e. the shape of a section perpendicular to the reference axis AX) of the first plurality of protrusions 102A or the second plurality of protrusions 102B are circle-like. The number of the first plurality of protrusions 102A or the second plurality of protrusions 102B is not particularly limited, as long as the number is sufficient to form the circle-like first plurality of protrusions 102A or the circle-like second plurality of protrusions 102B. The shapes of the first recess AC and the first protruding portion 201A1 are not particularly limited, as long as the shape of the first recess AC can match that of the first protruding portion 201A1 to form the engagement structure. The shapes of the second recess and the second protruding portion are not particularly limited, as long as the shape of the second recess can match that of the second protruding portion to form the engagement structure. The first angle and the second angle are between 1-40 degrees.

According to an embodiment of the present invention, the shape of the first plurality of protrusions 102A, the shape of the first recess AC and the shape of the first protruding portion 201A1 are all arcuate. The shape of the second plurality of protrusions 102B, the shape of the second recess and the shape of the second protruding portion are all arcuate as well.

In summary, the fixing apparatus and the automatic system of the present invention can allow the operator to not approach or contact any devices in the automatic system, which can be automatically performed. In addition, movements and procedures for all devices are planned in advance, and the shaft in the fixing apparatus can be quickly replaced to adapt to different product demands (e.g. different reels having different sizes), thereby achieving the effects of reducing the chance of damage to the fixing apparatus to reduce the material cost, reducing the labor cost and work accidents to reduce the personnel cost, enhancing the product yield and the production rate to achieve multi-batch mass production, and having the ability to produce various products.

EMBODIMENTS

1. A fixing apparatus for fixing a reel, comprising a shaft having a first end with a first plurality of protrusions and a second end with a second plurality of protrusions, wherein each of the first plurality of protrusions and one of its adjacent protrusions have a first recess therebetween, and each of the second plurality of protrusions and one of its adjacent protrusions have a second recess therebetween; and a supporting device, including a first supporting portion supporting the first end, and having a first protruding portion engaging the first recess when the first supporting portion accommodates the first end; a second supporting portion supporting the second end, and having a second protruding portion engaging the second recess when the second supporting portion accommodates the second end; a first component disposed on the first supporting portion, and having a first protruding element fixing the first supporting portion and the first end; and a second component disposed on the second supporting portion, and having a second protruding element fixing the second supporting portion and the second end.

2. The fixing device of Embodiment 1, further comprising a reference axis passing through the shaft and the supporting device; and a pneumatic unit connected to the supporting device, and receiving a first air for producing a pressure, wherein the pressure causes the first component to move along a first direction parallel to the reference axis, and causes the second component to move along a second direction opposite to the first direction.

3. The fixing device of any one of Embodiments 1-2, wherein the first component moves to a first position along the first direction to cause the first protruding element to engage with the first supporting portion and fix the first supporting portion and the first end.

4. The fixing device of any one of Embodiments 1-3, wherein the second component moves to a second position along the second direction to cause the second protruding element to engage with the second supporting portion and fix the second supporting portion and the second end.

5. The fixing device of any one of Embodiments 1-4, wherein the shaft has a first clamping portion and a second clamping portion to be clamped by a transporting device to move the shaft.

6. The fixing device of any one of Embodiments 1-5, wherein the first plurality of protrusions have a first number; each of the first plurality of protrusions has a first shape; the second plurality of protrusions have a second number; each of the second plurality of protrusions has a second shape; the first recess has a third shape; the second recess has a fourth shape; and the first number, the first shape, the second number, the second shape, the third shape and the fourth shape are designed so that the shaft body is secured on the supporting device when the shaft rotates at either direction with respect to the reference axis.

7. The fixing device of any one of Embodiments 1-6, wherein the first shape and the third shape are both arcuate.

8. The fixing device of any one of Embodiments 1-7, wherein the first number is 9.

9. The fixing device of any one of Embodiments 1-8, wherein the second shape and the fourth shape are both arcuate.

10. The fixing device of any one of Embodiments 1-9, wherein the second number is 9.

11. The fixing device of any one of Embodiments 1-10, wherein the first protruding portion has a fifth shape; and the second protruding portion has a sixth shape.

12. The fixing device of any one of Embodiments 1-11, wherein the fifth shape matches the third shape.

13. The fixing device of any one of Embodiments 1-12, wherein the sixth shape matches the fourth shape.

14. The fixing device of any one of Embodiments 1-13, wherein the transporting device is one selected from a group consisting of a cart, a crane and an automatic transporting device.

15. The fixing device of any one of Embodiments 1-14, wherein the shaft includes a plurality of grooves disposed on a surface of the shaft; and a plurality of buttons disposed on the shaft, wherein when one of the buttons is pressed, a second air is injected into the shaft to cause the shaft and the grooves to have an expanded state.

16. The fixing device of any one of Embodiments 1-15, wherein when the shaft sleeves thereon the reel having a hollow portion, the shaft in the expanded state will have a press-fit with the reel, to generate a friction between the grooves in the expanded state and an inner surface of the hollow portion.

17. The fixing device of any one of Embodiments 1-16, wherein the reel is one of a copper foil and a half-solidified sheet.

18. An automatic system for use in one of a printed circuit multilayer board plant and a copper foil substrate plant, comprising a reel; a fixing device fixing thereto the reel and including a shaft having a first end having a first plurality of protrusions, and a second end having a second plurality of protrusions, wherein each of the first plurality of protrusions and one of its adjacent protrusions have a first recess therebetween, and each of the second plurality of protrusions and one of its adjacent protrusions have a second recess therebetween; a supporting device, including a first supporting portion supporting the first end, and having a first protruding portion abutting one of the first recesses; and a second supporting portion supporting the second end, and having a second protruding portion abutting one of the second recesses; and a transporting device driving the shaft to the supporting device.

19. A fixing structure for fixing a reel, comprising a shaft having a first end having a first plurality of protrusions, and a second end having a second plurality of protrusions, wherein each of the first plurality of protrusions and one of its adjacent protrusions have a first recess therebetween, and each of the second plurality of protrusions and one of its adjacent protrusions have a second recess therebetween; and a supporting device, including a first supporting portion supporting the first end, and having a first protruding portion abutting the first recess; and a second supporting portion supporting the second end, and having a second protruding portion abutting the second recess.

20. The fixing structure of Embodiment 19, built in a sheet delivering machine for delivering a sheet material being the one reeled in the reel.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A fixing apparatus for fixing a reel, comprising:

a shaft having a first end with a first plurality of protrusions and a second end with a second plurality of protrusions, wherein each of the first plurality of protrusions and one of its adjacent protrusions have a first recess therebetween, and each of the second plurality of protrusions and one of its adjacent protrusions have a second recess therebetween; and a supporting device, including:

a first supporting portion supporting the first end, and having a first protruding portion engaging the first recess when the first supporting portion accommodates the first end;

a second supporting portion supporting the second end, and having a second protruding portion engaging the second recess when the second supporting portion accommodates the second end;

a first component disposed on the first supporting portion, and having a first protruding element fixing the first supporting portion and the first end; and a second component disposed on the second supporting portion, and having a second protruding element fixing the second supporting portion and the second end.

2. The fixing device as claimed in claim 1, further comprising:

a reference axis passing through the shaft and the supporting device; and a pneumatic unit connected to the supporting device, and receiving a first air for producing a pressure, wherein the pressure causes the first component to move along a first direction parallel to the reference axis, and causes the second component to move along a second direction opposite to the first direction.

3. The fixing device as claimed in claim 2, wherein the first component moves to a first position along the first direction to cause the first protruding element to engage with the first supporting portion and fix the first supporting portion and the first end.

4. The fixing device as claimed in claim 2, wherein the second component moves to a second position along the second direction to cause the second protruding element to engage with the second supporting portion and fix the second supporting portion and the second end.

5. The fixing device as claimed in claim 2, wherein the shaft has a first clamping portion and a second clamping portion to be clamped by a transporting device to move the shaft.

6. The fixing device as claimed in claim 5, wherein:

the first plurality of protrusions have a first number;

each of the first plurality of protrusions has a first shape;

the second plurality of protrusions have a second number;

each of the second plurality of protrusions has a second shape;

the first recess has a third shape;

the second recess has a fourth shape; and the first number, the first shape, the second number, the second shape, the third shape and the fourth shape are designed so that the shaft body is secured on the supporting device when the shaft rotates at either direction with respect to the reference axis.

7. The fixing device as claimed in claim 6, wherein the first shape and the third shape are both arcuate.

8. The fixing device as claimed in claim 6, wherein the first number is 9.

9. The fixing device as claimed in claim 6, wherein the second shape and the fourth shape are both arcuate.

10. The fixing device as claimed in claim 6, wherein the second number is 9.

11. The fixing device as claimed in claim 6, wherein:

the first protruding portion has a fifth shape; and the second protruding portion has a sixth shape.

12. The fixing device as claimed in claim 11, wherein the fifth shape matches the third shape.

13. The fixing device as claimed in claim 11, wherein the sixth shape matches the fourth shape.

14. The fixing device as claimed in claim 1, wherein the shaft includes:

a plurality of grooves disposed on a surface of the shaft; and a plurality of buttons disposed on the shaft, wherein when one of the buttons is pressed, a second air is injected into the shaft to cause the shaft and the grooves to have an expanded state.

15. The fixing device as claimed in claim 14, wherein when the shaft sleeves thereon the reel having a hollow portion, the shaft in the expanded state will have a press-fit with the reel, to generate a friction between the grooves in the expanded state and an inner surface of the hollow portion.

16. The fixing device as claimed in claim 15, wherein the reel is one of a copper foil and a half-solidified sheet.

* * * * *